United States Patent [19]

Savenije

[11] Patent Number: 4,873,737

[45] Date of Patent: Oct. 17, 1989

[54] FLUID FILLED MATTRESS WITH HEIGHT MEASURING AND CONTROL DEVICES

[75] Inventor: Franciscus G. Savenije, Deventer, Netherlands

[73] Assignee: Auping B.V., Netherlands

[21] Appl. No.: 917,219

[22] Filed: Oct. 9, 1986

[30] Foreign Application Priority Data

Oct. 11, 1985 [NL] Netherlands ..... 8502789

[51] Int. Cl.[4] ..... A47C 27/08; A47C 27/10

[52] U.S. Cl. ..... 5/453; 5/455

[58] Field of Search ..... 5/453, 449, 455, 456, 5/450, 451; 297/DIG. 3

[56] References Cited

U.S. PATENT DOCUMENTS

| | | | |
|---|---|---|---|
| 4,224,706 | 9/1980 | Young et al. | 5/455 |
| 4,525,886 | 7/1985 | Savenije | 5/449 |
| 4,542,547 | 9/1985 | Sato | 5/453 |
| 4,634,179 | 1/1987 | Hashimoto et al. | 297/DIG. 3 |
| 4,679,264 | 7/1987 | Mollura | 5/455 |
| 4,686,722 | 8/1987 | Swart | 5/453 |

FOREIGN PATENT DOCUMENTS

| | | |
|---|---|---|
| 0116470 | 8/1984 | European Pat. Off. . |
| 0122666 | 10/1984 | European Pat. Off. . |
| 2922619 | 12/1980 | Fed. Rep. of Germany . |
| 3400425 | 8/1985 | Fed. Rep. of Germany . |
| 7906927 | 9/1979 | Netherlands . |
| 8301197 | 4/1983 | Netherlands . |
| 2134382 | 8/1984 | United Kingdom . |

*Primary Examiner*—Alexander Grosz

*Attorney, Agent, or Firm*—Leydig, Voit & Mayer

[57] ABSTRACT

This invention relates to a mattress (1) with one or more closed chambers (23) which are filled with a fluid and connected to means (20, 27) for supplying or removing fluid to or from a chamber (23) each chamber having a device (5,6,24,25) for measuring the distance between the top face and the bottom face of the chamber. The value of the measure distance can be compared with a desired or preset value can be displayed and can be used for manual or automatic control of the contents of each chamber.

17 Claims, 5 Drawing Sheets

FLUID FILLED MATTRESS WITH HEIGHT MEASURING AND CONTROL DEVICES

The invention relates to a mattress with a closed chamber which is filled with a gaseous or liquid fluid, combined or not combined with an elastic foram plastic filling, which chamber is provided with means for supplying or removing fluid to or from the chamber.

Such a mattress is generally known. The chamber or chambers of the mattress may be filled with air or with liquid. Examples of such a mattress can be found in the laid-open Dutch Patent Applications 7,906,927; 8,200,401; and 8,301,197.

In the case of a mattress filled with fluid, the softness or hardness of the mattress is determined by a certain number of factors. A gaseous fluid, such as air, is itself compressible. The pressure of the fluid then determines the character of the mattress. If a liquid fluid, such as water, is used it is the specific mass of the fluid, the degree of filling of the chamber and the elasticity of the material of the chamber which matter. In both cases, measurement of the pressure, either by feel or with measuring apparatus, is generally known and, in the case of a mattress which has several chambers, the use is also known of different pressures per chamber with a view to making it possible to match the mattress to the shape and to the weight proportion of the user. In the case of a liquid fluid, pressure measurement is not a good graduator for determining the character of the mattress.

Pressure measurements offer insufficient information for obtaining a precise matching of the mattress to the user. After all, users have divergent sizes and different ratios of volume to weight of the respective body parts or body zones.

In the case of some of the older proposals mentioned above, an attempt has been made to solve this problem by transmitting the weight of the user to the mutually connected chambers of the mattress by interposing elements of different surface in order to obtain, in this manner, a matching of the ratio of the volume to weight of the different parts of the user. In the case of the mattress according to the Dutch Application 8,301,197, each air chamber may have its own pressure value.

The object of the invention is to provide a mattress in which matching to the user can take place in a simpler and much more precise manner and in which the effect of the weight of the user no longer plays a role.

This object is achieved according to the invention in that the mattress is provided at least at one point with a measuring device for measuring the distance between the top surface of the chamber and the bottom surface of the chamber and said measuring device is connected to a device for making use of the measured values, such as a read-off device.

Instead of measuring the pressure in the chamber or chambers of the mattress the depression is now therefore measured and used according to the invention, after which matching can be brought about, if necessary, by supplying or removing fluid. As a result it is possible to impart a value of softness or hardness to the mattress required by the user and also to perform all this in a manner such that the mattress will exhibit the same depression regardless of whether the user is light or heavy and, in particular, by supplying or removing fluid in the event of deviations from the required value of level.

In its simplest form, such a mattress has a single air chamber which is provided at a suitable point, for example in line with the point where the pelvis of the user might be situated, with a measuring device.

According to the invention it is also possible to provide several measuring devices at a distance from each other and to connect them to a device which determines the mean of the different measurements and makes use of, or makes it possible to read off, said mean value.

The most expedient embodiment is, however, obtained if in the case of a mattress which is provided with several chambers as known per se, each chamber or group of chambers according to the invention is provided with its own measuring device. These can then again be coupled in such a manner to each other that a mean is determined and made use of, in particular, if the chambers are mutually connected, but preferably the measuring device of each chamber or group of chambers is coupled to a device for making use of, or making it possible to read off, the measurements. The level can be adjusted in the precise manner for each chamber or group of chambers, which is of importance both for an ordinary mattress which rests on a, preferably stiff, undermattress, and also for a mattress which is intended for therapeutic purposes and for which the doctor providing treatment can therefore determine as required the precise lying position of the user.

In all cases it is desirable that the read-off device or the device for making use of the measurements is provided with a memory so that the values adjusted are reproducible. Such a memory may be very simple, for example in the form of displaceable indicators on a scale, but it may also be more complicated in the form of an electronic memory.

On a read-off device the required value of the level for a particular user can, of course, be readoff and it can be seen on the basis of the visible measurement on the read-off device how far it differs from the required value. Adjustment can then be carried out in a simple manner either by supplying fluid or by removal through a valve.

In the case of a mattress filled with air, the supply of air can be achieved in a simple manner by means of an air pump which, for example, can be formed by a compartment of the mattress. Each air chamber has an escape opening which can be shut off and it is possible without much difficulty to provide a valve at that point which can be manually operated by the user.

In a preferred embodiment of the mattress according to the invention, the pump is an electrical pump, while the measuring device or measuring devices is/are coupled respectively to a level regulator which is embodied in the electrical circuit of the pump in a manner such that it switches on the pump at a measured level which is lower than that set on the level regulator and switches off the pump on reaching said set level. In the case of such a mattress, the setting of the required level on the level regulator will take place automatically if the level is too low. If the level is too high, use can be made of the release valve.

According to the invention the release valve may furthermore be an electrically controlled valve which is embodied in the electrical circuit of the measuring device or measuring devices and of the level regulator in a manner such that said valve opens at a measured level value which is greater than the value set on the level regulator. In said embodiment the release valve is therefore automatically constructed and will release if the level is higher than the level which is set on the level regulator as the desired level.

These automatic control systems can, of course, be used in a mattress with one chamber, with several chambers, or groups of chambers.

Users of a mattress do not lie still. Mattresses are also used for sitting on. This means that the mattress may locally undergo sudden changes in level. Automatic regulating systems such as have just been described must not respond immediately in such case. According to the invention this can be achieved in that the mattress is provided with an electronic regulating device which compares the extent of fluctuations of the measured values with a set value and switches the pump or the valve off for fluctuations of less than 5% or more than 50%. Sudden movements, for example as a result of the user sitting up or changing from a back lying position to a side lying position result in pressure surges which are registered by the pressure sensor so that it temporarily delays or blocks the automatic regulation.

According to the invention it may therefore also be of importance that the regulating device switches off the pump or the valve for fluctuations which have a short duration of, for example, less than 5 seconds.

The blocking thus takes place depending on the deviation in level and is thus not dependent on the pressure surge. This last regulating system, which is based on a deviation in level, is especially of importance in cases where prolonged local loading is important, for example as a result of someone sitting on the mattress. Level changes which last for less than 5 seconds and/or are small (less than 5%) are therefore ignored. Large changes resulting, for example, from sitting are likewise ignored.

The measuring device may be realized in many ways. Thus, use can be made of induction loops and a circuit which measures the distance between the induction loops.

Use can be made as well of a resistor the value of which changes upon shortening of the length. A current conductive foam in the interior of the mattress the resistance of which decreases on depression, is conceivable. Other methods of measurement are, however, also conceivable.

The invention will now be explained in more detail by reference to the drawings.

Figure 1:
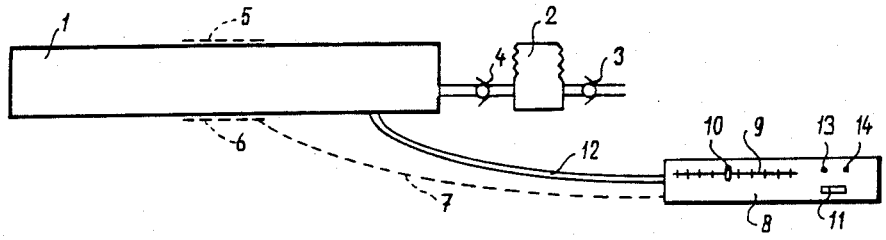
FIG. 1 shows an embodiment of the mattress according to the invention diagrammatically in side view.
Figure 1A:
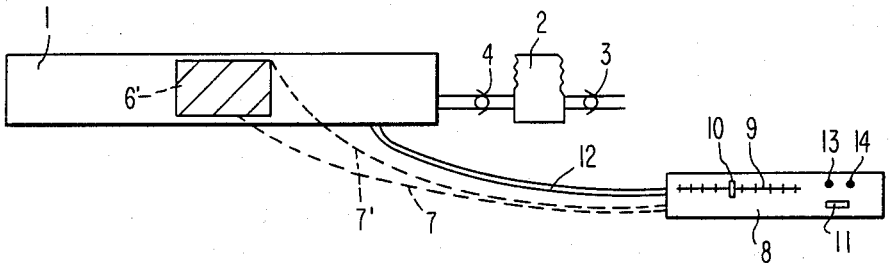
FIG. 1A shows another embodiment of the mattress according to the invention diagrammatically in side view.

FIG. 1 shows an air mattress 1 which is permanently connected to a pump 2, which may be formed by a compartment of the mattress, which pump has a nonreturn inlet valve 3 and an nonreturn outlet valve 4. At 5 and 6 there is located one or more induction loops, the operation of which will be described later on and which serve to measure the mutual distance between the loops 5 and 6. Instead of the induction loops 5, 6, it is possible to use a resistor whose resistance varies with alteration of length. For example, it is possible to use a current conductive foam block 6' in a current circuit 7, 7', as shown in FIG. 1A. The measured value for the distance is fed through the connection 7 to a device 8 with a scale 9 on which the value can be read off. A cursor which can be moved over the scale may be used as a memory or as an indication of the required level. At 11 a push button is indicated by means of which air can be released via the pipe 12 while 13 and 14 may be indicator lamps which indicate that the indicate that the level is too high or too low.

If the level is too low, the user should pump air into the mattress by means of the pump 2. If the level is too high, he can allow air to escape by means of the release valve 11.

Figure 2:
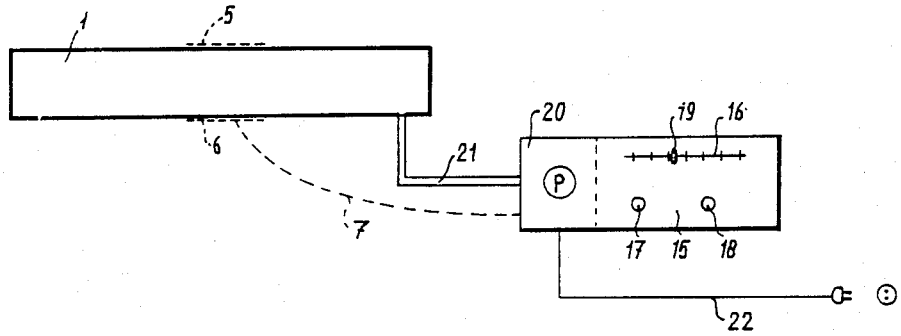
FIG. 2 shows, in the same manner as FIG. 1, a mattress according to the invention in a different embodiment.

In the embodiment of FIG. 2, the mattress is likewise provided with induction loops 5 and 6 which supply a measured value via the connection 7 to the device 15 which is provided with a scale 16, maximum and minimum indicator lamps 17 and 18 and a sliding regulator 19 by means of which the required level can be set, which device 15 also contains an electrical pump 20 which can supply air to the mattress via the line 21. Said device 15 is connected via cable 22 to the mains and has an electrically controllable release valve (not shown).

A required level can be set with the sliding regulator 19, after which said device automatically either feeds air or releases air, and indicates by means of the indicator lamps 17 and 18 what is happening.

Figure 3:
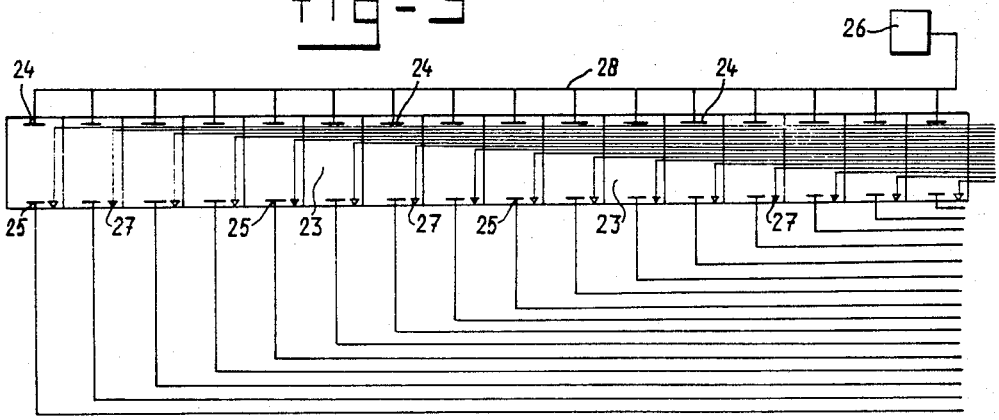
FIG. 3 shows a further embodiment.

The embodiment of FIG. 3 relates to a mattress which is constructed of a large number of separate cells 23, each provided with a top induction loop 24 and a bottom induction loop 25.

The top loops are all connected to an oscillator 26 which acts as a transmitter. The bottom loops 25 each have their own connection to the device which makes the measured value visible or usable.

Each chamber 23 also has a release valve 27 which likewise has its own connection to the device concerned.

Figure 4:
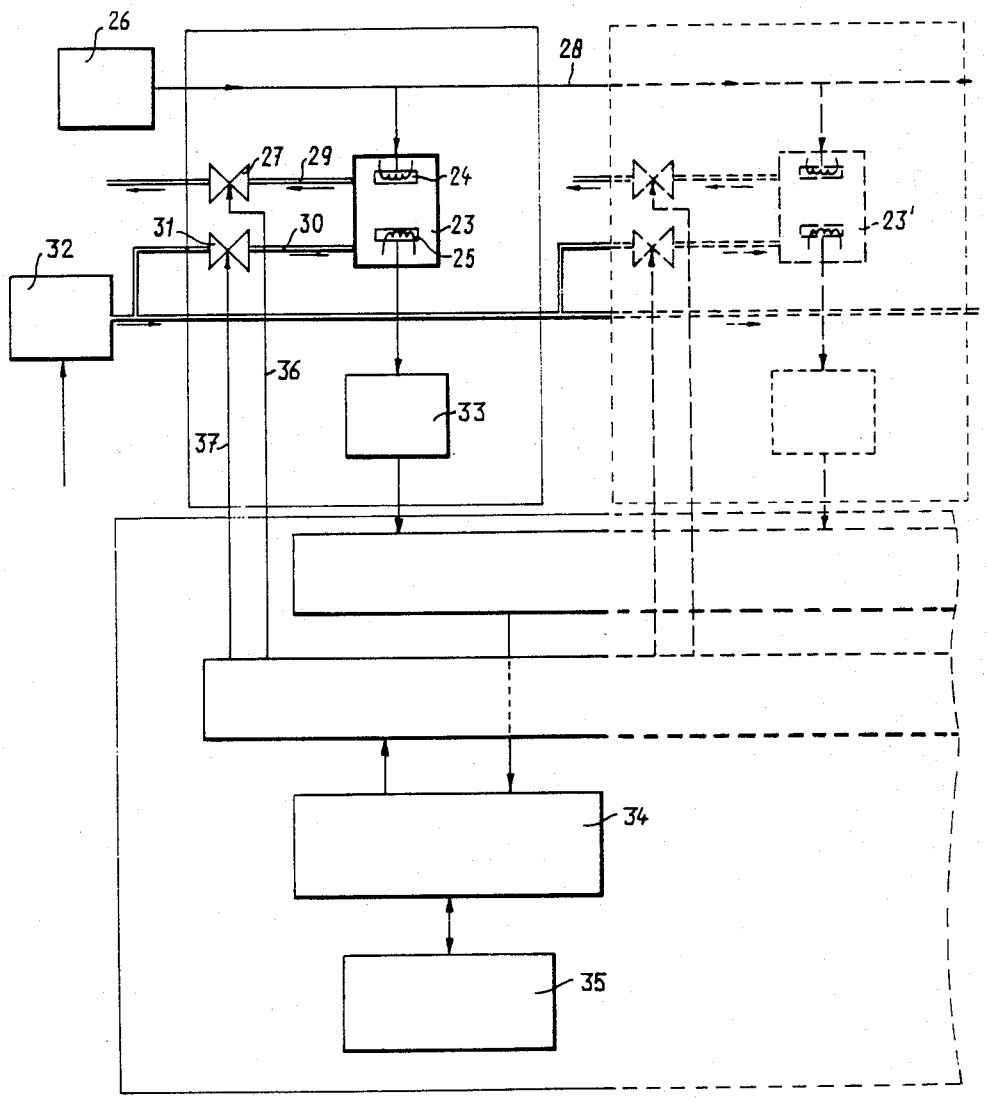
FIG. 4 is a circuit diagram pertaining to the embodiment of FIG. 3.

FIG. 4 shows the circuit diagram pertaining to the embodiment of FIG. 3. In this circuit diagram a chamber 23 is shown by a full line and an adjacent chamber 23' by a broken line. The oscillator 26 is connected via the connection 28 to the induction loop or coil 24. Each chamber therefore has one.

Each chamber 23 has a release line with valve 27 which is electrically controllable and each chamber has a supply line 30 with valve 31 which is likewise electrically controllable and connected to a pump with pressure vessel 32.

The bottom induction loop 25 of each chamber 23 gives its measure value, determined in the device 33, to an analogue input apparatus with as many channels as there are pressure chambers, for example sixteen, from which device said values go to a microprocessor 34 with a keyboard 35 and possibly a display screen, which microprocessor 34 controls the separate chambers 23, 23' etc. via thirty two outputs, viz. sixteen outputs 36 for the release valves 27 and sixteen outputs 37 for the supply valves 31 for the pressure fluid.

This device, shown only diagrammatically, can readily be constructed in a manner such that it becomes visible on the display screen which levels are measured per chamber. If it is then known what the required value per chamber is, it is possible to enter it by means of the keyboard and thereby generate a lying position for a user which is reproducible.

Figure 5:
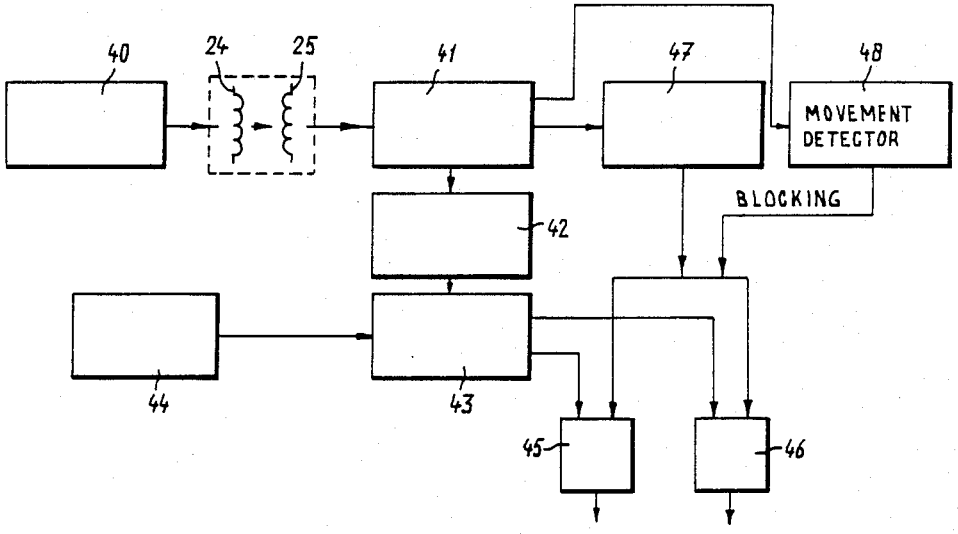
FIG. 5 is a block diagram of a possible automatic control system for a mattress with one or more measuring devices.

The block diagram in FIG. 5 shows a sine-wave oscillator 40 which operates at approximately 1000 Hz and emits this vibration via the coil or loop 24 situated in the mattress or in a chamber of the mattress. Said vibration is received by the loop or coil 25 and, in particular, to a more or less powerful extent depending on the mutual distance between the loops 24 and 25. From the induced voltage generated in 25 the section 41 obtains the amplitude measurement which, via the determination of a mean in 42, is supplied to a comparator 43 which compares the mean value, possibly delayed in 42, with the setting in 44.

At 45 and 46 there are relays for setting or not setting a pump or a valve into operation. 47 indicates a switching section which serves to block both pump relay 45 and valve relay 46 if there is no load on the bed. Between 41 and the relays 45 and 46 there is a movement detector 48 which is likewise capable of blocking.

Figure 6:
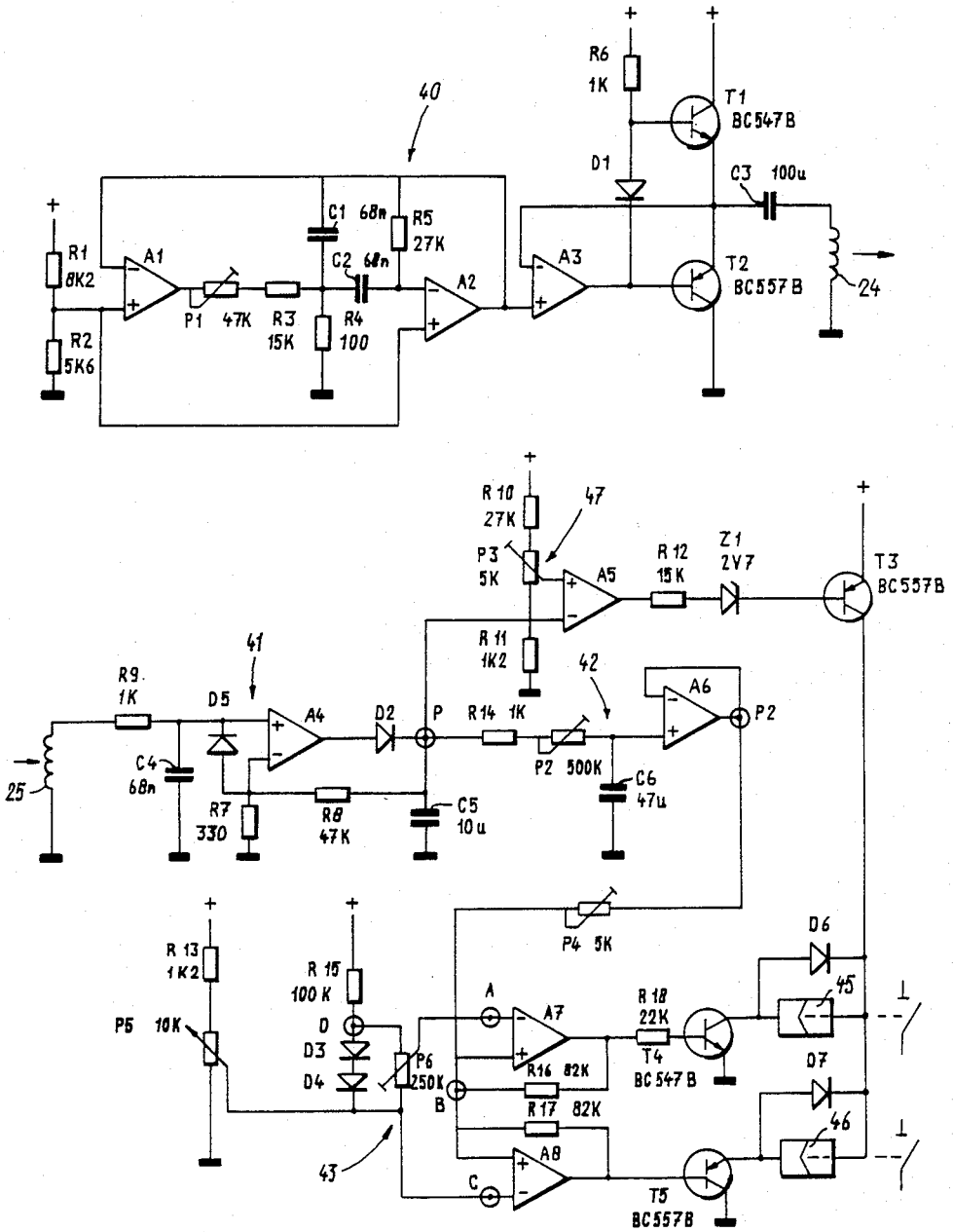
FIG. 6 shows the circuit diagram of an embodiment based on the block diagram of FIG. 5.

FIG. 6 relates to the electronic circuit diagram pertaining to the block diagram of FIG. 5. The upper section relates to the sine-wave oscillator 40. This consists of a comparator, a band pass filter and an amplifier.

It contains the resistors R1 and R2 on the left in the circuit diagram which may have a value of, for example, 8200 Ohm and 5600 Ohm respectively. These two resistors form a voltage divider which converts the voltage of, for example, 12 V into a reference voltage for the operational amplifier A1 and also for the operational amplifier A2. In this manner a comparator is obtained which compares the output of A2 with the reference voltage, it being possible for the squarewave voltage at the output to vary between 0 and 10 V.

In this circuit diagram P1 is a variable potentiometer which is placed in series with the resistor R3 which, with a maximum value of, for example, 4700 Ohm for P1 and 1500 Ohm for R3, can attenuate the square-wave voltage adjustably in conjunction with R4 which is, for example, 100 Ohm.

The resistor R4 and the capacitors C1 and C2, the resistor R5 and the operational amplifier A2 together form a band pass filter which produces from the square-wave voltage a sinusoidally varying voltage which is available at the output of A2 and is fed back to the operational amplifier A1. The amplitude is limited because the output of A1 is constrained by the supply voltage. The frequency of approximately 1000 Hz is determined by the resistors R4, R5 and the capacitors C1 and C2. Said capacitors may have a value in Farads of 68 nF and the resistor R5 may have a value of 2700 Ohm.

On the right hand side in this circuit diagram is the current amplifier consisting of the operational amplifier A3 and the transistors T1 and T2. The base of the transistor T2 is driven directly and the base of the transistor T1 is driven via the diode D1 and the resistor R6. The diode D1 partially compensates for the two base junctions and the resistor R6 keeps the diode D1 in conduction. The common emitter output is fed back via the operational amplifier A3. The capacitor C3, having a value of, e.g., 100 F decouples the DC and generates a fluctuating magnetic field in the coil 24 which then acts as a transmitter.

Said magnetic field is transmitted as an induced voltage to the coil 25, the induced voltage in which is the greater, the smaller the distance between the two coils is.

The amplitude of said induced voltage is first measured by means of a low-pass filter and a half-wave rectifier. The resistor R9 and the capacitor C4 form the low-pass filter. This filters any high-frequency signals such as radio reception signals, interference etc. out of the incoming signal.

The amplifier A4 amplifies the positive pulses and as soon as the voltage of the noninverting input is higher than one fifteenth (R7/(R7+R8)) of the voltage on the capacitor C5, the capacitor will be charged up by the amplifier A4 via the diode D2. While this is not the case, the capacitor C5 discharges via the resistors R7 and R8. This means that fifteen times the maximum voltage of the positive peaks of the received signal unaltered by Up is always present at the point P.

The operational amplifier A5 compares said signal Up with a value set by means of the potentiometer P3. If the signal Up is lower than the set value, the output of the amplifier A5 goes towards the positive voltage. The transistor T3 will not then conduct and because it controls the two relays 45 and 46, the latter will not be energized and neither the pump nor the valve can be put into operation.

In this manner steps are taken to ensure that all the regulating systems are switched off as soon as the bed is empty.

The resistors R10 and R11 provide for a coarse adjustment of the comparison value and the variable potentiometer for the fine adjustment, while the resistor R12 limits the base current of the transistor T3. This connection also contains in addition the Zener diode Z1 which is necessary because the output of the operational amplifier A5 cannot go all the way to the positive voltage.

The resistor R14, the variable potentiometer P2, the capacitor C6 and the operational amplifier A6 jointly form a low-pass filter.

If movements are taking place of the person situated on the mattress, the signal Up will vary considerably. It is naturally of importance that the pump or valve does not continuously react to this. Only the control system discussed earlier, which indicates that the bed is empty, must react rapidly.

Said low-pass filter now ensures that the values of the output signal Up are averaged. If the potentiometer P2 is set to a large resistance, the filtered output signal Up will only slowly follow the original signal Up. At the output of A6 there is then the mean signal Up2 at the point P2.

In the remaining section of the circuit diagram of FIG. 6 it is keeping the filling of the mattress at the required value that is important.

The signal Up2 is in this case compared with the value which is set, for example, by the user and which is set by means of the potentiometer P5. If the distance is greater than set, the mattress is too full and the control system should then ensure that the valve is opened by energizing the relay 46.

If the distance is smaller than the set distance, the mattress is too empty and the pump should be put into operation by means of the relay 45.

It is of importance that within a certain margin around the set value neither pump nor valve operate. The filling is then correct and everything should remain at rest.

The potentiometer P4 and the resistors R16 and R17 provide for a small hysteresis at the upper and lower limits to stablize the relays.

At the point C is the voltage which is set with the potentiometer P5 in conjunction with the resistor R13.

The voltage at D is determined by the resistor R15 and the diodes D3 and D4 and is 1.3 V lower than the point C. The voltage at point A is between 0 and 1.3 V (which voltage can be adjusted by means of the variable potentiometer P6) higher than the voltage at point C.

If therefore the output signal Vb at this point is already lower than Vc, i.e. the signals at the position of the points b or c, the operational amplifier A8 goes towards zero and energizes the relay 46 via the transistor T5. The valve then opens.

If the signal Ub is larger than the signal Ua, the operational amplifier A7 goes towards the positive voltage and the transistor T4 is rendered conducting via the current-limiting resistor R18, as a result of which the relay 45 is energized and the pump starts to operate.

The diodes D6 and D7 short circuit induction pulses from the relay coils.

The values which are given in FIG. 6 for the resistors, capacitors etc., are only an example.

The invention makes it possible to identify shape or to identify posture if the mattress has several chambers with a measuring device in each chamber.

The microcomputer coupled to the system is provided with a program which identifies a certain posture, viz. lying on the back or lying on the stomach or sitting, this being done from the changing values compared with the preceding values.

The microcomputer then provides appropriate commands which deliver values pertaining to the new posture.

I claim:

1. A mattress comprising a closed chamber which is filled with a fluid and which is provided with at least one of a means for supplying fluid to the chamber and a means for removing fluid from the chamber, the mattress further comprising at least at one point a measuring device for measuring the distance between the top face of the chamber and the bottom face of the chamber, said measuring device being connected to a device for making use of the measured values, such as a read-off device.

2. A mattress according to claim 1, wherein the chamber is provided with several measuring devices at distances from each other and said measuring devices are connected to single device which determines the mean of the measured values and makes said mean capable of being used.

3. A mattress according to claim 1 provided with several chambers, wherein each chamber is provided with a measuring device.

4. A mattress according to claim 3, wherein the measuring device of each chamber is coupled to a device for making use of the measurements.

5. A mattress according to claim 3 wherein the measuring devices of the chambers are coupled to a micro computer having a memory which computer determines the measured values pertaining to certain positions and controls the pump or valve to match an altered lying position.

6. A mattress according to claim 1 further comprising a memory, the measurements of the measuring device being fed to the memory.

7. A mattress according to claim 1 further comprising and electric pump and a release valve, the electric pump including a level regulator which is embodied in the electrical circuit of the pump and is coupled to the measuring device in a manner such that it switches on the pump at a measured level which is lower than a predetermined level set on the level regulator and switches off the pump on reaching said set level.

8. A mattress according to claim 7, wherein the release valve is an electrically controlled valve which is embodied in the electrical circuit of the measuring device and of the level regulator in a manner such that said valve opens at a measured level value which is greater than the value set on the level regulator.

9. A mattress according to claim 6 further comprising an electronic regulating device which compares the extent of fluctuations of the measured values with a set value and that the regulating device switches off the pump or valve for fluctuations of less than 5% or more than 50%.

10. A mattress according to claim 9 wherein the regulating device switches off the pump or valve at fluctuations which last for less than 5 seconds.

11. A mattress according to claim 10, further comprising an electronic regulating device which compares the measured values with a set value and which switches off the pump or valve operation if the measured values are less than the set value.

12. A mattress according to claim 1 wherein, the measuring device comprises induction loops.

13. A mattress according to claim 12, further comprising an electronic regulating and controlling device which determines a mean from the measurements obtained and compares it with a set value.

14. A mattress according to claim 1 wherein the measuring device comprises a resistor such as current-conducting foam having a length extending between the top and bottom faces of the chamber, the resistance value of which alters with alteration of the length.

15. A mattress assembly comprising a mattress which includes a top face for supporting a user, a bottom face, a chamber disposed between the top and bottom faces of the mattress, and a measuring device coupled to the chamber for measuring the distance between the top and bottom faces of the mattress and generating electronic signals in accordance with the measured distance and a fluid control system connected to the chamber and the measurement device for controlling the amount of fluid in the chamber in accordance with the signals generated by the measurement device.

16. A mattress according to claim 15 wherein the measuring device includes first and second induction loops respectively disposed proximate the top face and the bottom face of the mattress.

17. A mattress according to claim 15 wherein the measuring device includes a current conductive foam block disposed between the top face and the bottom face of the mattress.

* * * * *